US006533672B1

(12) United States Patent
Keller et al.

(10) Patent No.: US 6,533,672 B1
(45) Date of Patent: Mar. 18, 2003

(54) ROTATABLE AND PIVOTABLE AMUSEMENT APPARATUS

(75) Inventors: Mike Keller, Tallmadge, OH (US); Jeffrey R. Gatto, Lyndhurst, OH (US); Michael Miroewski, Aurora, OH (US)

(73) Assignee: The Little Tikes Company, Hudson, OH (US)

( * ) Notice: Subject to any disclaimer, the term of this patent is extended or adjusted under 35 U.S.C. 154(b) by 0 days.

(21) Appl. No.: 10/024,947

(22) Filed: Dec. 19, 2001

Related U.S. Application Data

(63) Continuation-in-part of application No. 09/704,939, filed on Nov. 2, 2000, now Pat. No. 6,379,256.

(51) Int. Cl.[7] ..... A63G 11/00
(52) U.S. Cl. ..... 472/110; 472/109; 472/104
(58) Field of Search ..... 472/95, 102, 103, 472/106, 110, 113, 114, 135

(56) References Cited

U.S. PATENT DOCUMENTS

| | | | | |
|---|---|---|---|---|
| 43,972 | A | 8/1864 | Coldwell | |
| 100,083 | A | 2/1870 | Stephan | |
| 1,586,254 | A | 5/1926 | Lovejoy | |
| 1,821,462 | A | 9/1931 | Colella | |
| 1,832,755 | A | 11/1931 | Waddell | |
| 1,898,466 | A | 2/1933 | Pierson | |
| 2,173,300 | A | 9/1939 | Heldman | |
| 2,201,036 | A | 5/1940 | Guerrier | |
| 2,527,763 | A | 10/1950 | Probst | |
| 2,726,085 | A | 12/1955 | Brand | |
| 2,735,679 | A | 2/1956 | Mortenson | |
| 2,873,118 | A | 2/1959 | Dimitriadis | |
| 3,117,780 | A | 1/1964 | Gregory | |
| 3,514,103 | A | 5/1970 | Lieberman | |
| 3,595,569 | A | 7/1971 | Holte | |
| 3,602,500 | A | 8/1971 | Cackowski | |
| 4,341,377 | A | 7/1982 | Ahrens | |
| 5,547,425 | A | 8/1996 | Krhs et al. | |
| 6,379,256 | B1 * | 4/2002 | Gatto | 472/109 |

OTHER PUBLICATIONS

Hedstrom, Toys, Video Games, Software, and Collectibles at KBKIDS.com, Teeter Twirl, Sep. 12, 2000.
Hedstrom, Gorilla Rock and Bounce, 96.

* cited by examiner

*Primary Examiner*—Kien T. Nguyen
(74) *Attorney, Agent, or Firm*—Piper Rudnick

(57) ABSTRACT

An amusement apparatus that includes a base, an arm, a seat biasing device and a arm biasing device. The base is configured for placement on to a generally horizontal surface. The arm has a distal end and a proximal end. The proximal end of the arm is rotatably and pivotally coupled to the base. The distal end of the arm includes a seat. The seat biasing device is coupled to the seat and configured to repeatedly and resiliently contact the surface. The arm biasing device is coupled to a pivot member and the proximal end of the arm. The arm biasing device is configured to upwardly bias the seat of the arm.

13 Claims, 5 Drawing Sheets

ROTATABLE AND PIVOTABLE AMUSEMENT APPARATUS

CROSS REFERENCE TO RELATED APPLICATIONS

This application is a continuation-in-part of U.S. application Ser. No. 09/704,939 filed Nov. 2, 2000.

FIELD OF THE INVENTION

The present invention relates generally to an amusement apparatus. More particularly, the invention relates to a rotatable and pivotable riding toy.

BACKGROUND OF THE INVENTION

Children enjoy playing on riding toys and playground, particularly toys that move in a generally cyclical, up and down, or circular motion. The classic teeter totter remains a favorite recreational toy for children. Children enjoy the sensation of jumping off, or being lifted from, the ground. Other toys which enable a child to sit and move in a generally circular manner are also traditional favorites. Children also enjoy bouncing toys including trampolines and large bouncing balls (often referred to as hippity-hop balls). Children particularly enjoy riding toys which enable them to expend energy. All of these toys provide essential proprioceptic input for developing children.

Existing riding toys including teeter totters and large rotating play devices, however, have a number of drawbacks. Traditional teeter totters require two children of generally equivalent weight to operate. Teeter totters typically provide only pivotal up and down motion about a fulcrum. The fixed up and down motion of the teeter totter typically does not attract a child's attention for a long period of time. Additionally, teeter totters are typically not configured to soften the impact to the child from either end of the teeter totter contacting the ground. This often results in a jarring impact between one child and the ground when the second child lifts off the opposite end of the teeter totter. Rotating toys typically also do not include the ability for the child to move up and down. Additionally, rotating toys are often large, heavy, difficult to operate, difficult to stop and difficult to reverse in direction. Moreover, teeter totters and large rotating riding toys often have unsafe, sharp comers and edges. Some toys have attempted to combine a rotating riding toy with a single child teeter totter. Such devices often have a counterweight assembly dangerously suspended on an opposite end of the teeter totter type rod. The large and heavy counterweight assembly of such toys counteracts the movement of the child riding the toy such that the counterweight assembly swings left or right and up and down creating a safety hazard for children observing or playing nearby. Further, existing riding toys such as teeter totters and large rotatable toys are typically not suitable for home use due to their size and weight, and because such toys are not designed to softly impact the surface upon which the toys rest.

Large bouncing balls provide the ability for a child to bounce up and down and to direct the ball in different directions. However, such balls also are easily rotated, such that the handle rotates toward the surface, which often results in the child falling from the ball. The huge bouncing balls can also be difficult for a child to control and can result in the child inadvertently bouncing in an undesired direction.

Thus, there is a continuing need for an improved riding toy which enables a single child to safely and easily bounce up and down and, if the child desires, to rotate about a fixed pivot point without inadvertently bouncing in an unintended direction. It would also be advantageous to provide a pivotable and rotatable toy that enables a child to softly impact the ground during bouncing. What is needed is an affordable rotatable and pivotable riding toy that is safe for home or playground use. Also, what is needed is a rotatable and pivotable riding toy that is easily adjustable to children of different sizes and does not include an unsafe outwardly projecting counterweight device. It would be advantageous to provide a bouncing toy that assists a child in lifting off the ground during bouncing.

SUMMARY OF THE INVENTION

The present invention provides a rotatable and pivotable amusement apparatus that safely enables a single child to easily bounce up and down or to easily rotate about a base. The rotatable and pivotable amusement apparatus provides a resilient seat biasing device, enabling a child to softly and safely impact the ground during bouncing. The apparatus also maintains the seat in an upright position, thereby eliminating the risk of the resilient biasing device tipping over.

According to a principal aspect of the invention, an amusement apparatus includes a base, an arm and a seat biasing device. The base is configured for placement on a generally horizontal surface. The arm has a distal end and a proximal end. The proximal end of the arm is rotatably and pivotally coupled to the base. The distal end of the arm includes a seat. The seat biasing device is coupled to the seat and configured to repeatedly and resiliently contact the surface.

According to another aspect of the invention, an amusement apparatus includes a base, an arm and a biasing member. The base is configured for placement on a generally horizontal surface. The arm has a distal end and a proximal end. The proximal end of the arm is rotatably and pivotally coupled to the base. The distal end of the arm includes a seat. The biasing member is coupled to the base and the proximal end of the arm, and the biasing member is configured to upwardly bias the seat of the arm.

According to another aspect of the invention, an amusement apparatus includes a base, an arm and a resilient ball. The base is configured for placement on a generally horizontal surface. The arm has a distal end, and the arm is rotatably and pivotally coupled to the base. The distal end of the arm includes a seat, and the resilient ball is coupled to the seat.

According to an alternative embodiment of the invention, an amusement apparatus includes a base, an arm, a seat biasing device and an arm biasing device. The arm has a proximal end and a distal end. The proximal end of the arm is rotatably and pivotally coupled to the base. The distal end of the arm includes a seat. The seat biasing device is coupled to the seat. The arm biasing device is connected to the base and the proximal end of the arm. The arm biasing device upwardly biases the seat of the arm.

This invention will become more fully understood from the following detailed description, taken in conjunction with the accompanying drawings described herein below, and wherein like reference numerals refer to like parts.

DETAILED DESCRIPTION OF THE PREFERRED EMBODIMENTS

Figure 1:
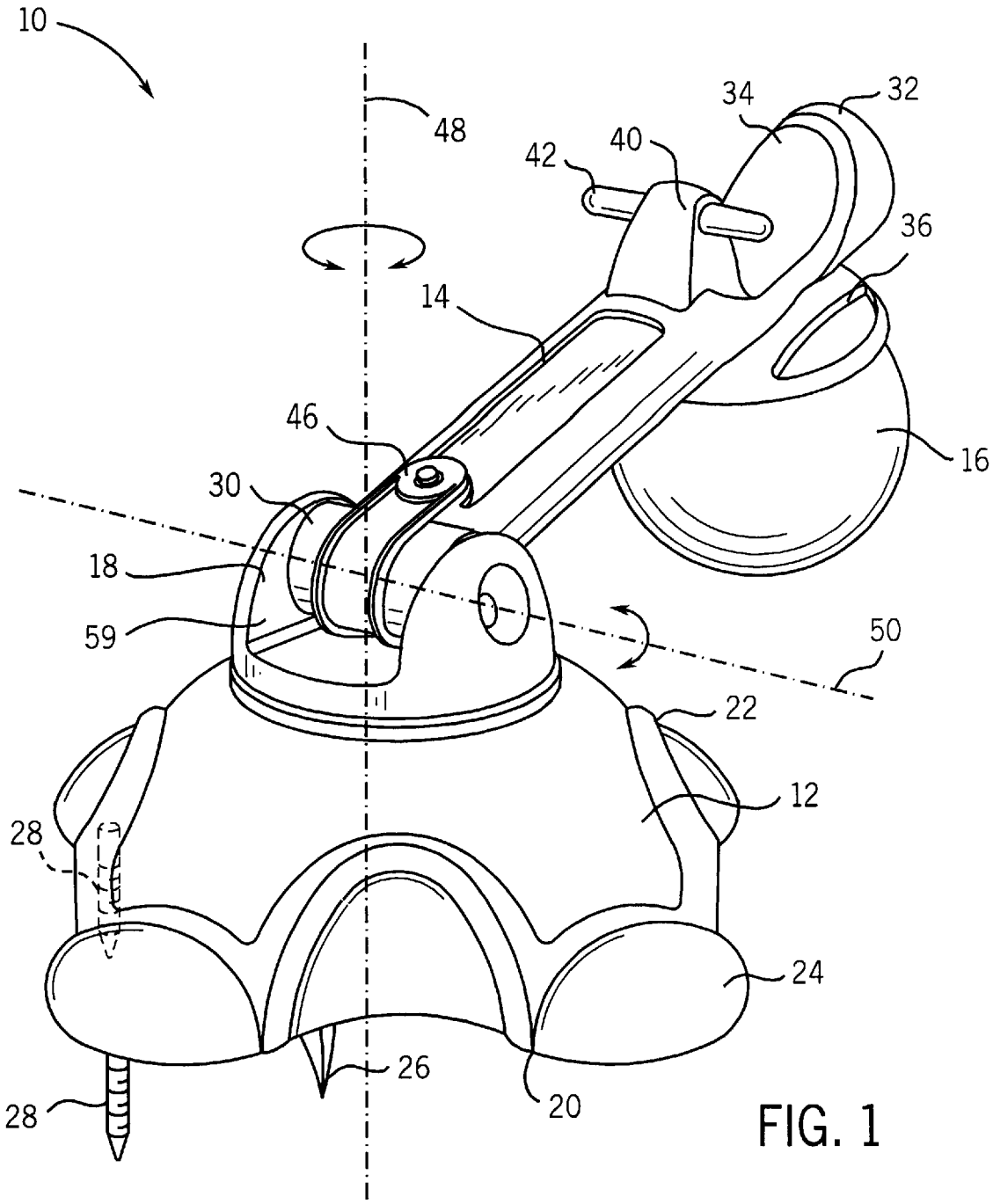
FIG. 1 is a perspective view of an amusement apparatus in accordance with the present invention.

FIG. 1 illustrates a rotatable and pivotable amusement apparatus 10. The amusement apparatus 10 includes a base 12, an arm 14, a pivot member 18, and a seat biasing device, which is preferably a resilient ball 16.

The base 12 is a support structure. In a preferred embodiment, the base 12 is hollow and is configured to hold a substance, such as, for example: water, sand, stones, weights, dirt or a combination thereof. The base 12 includes a generally flat lower surface 20 and an upper surface 22. The lower surface 20 of the base 12 is configured for placement on a generally horizontal surface. In a preferred embodiment, the base 12 has a generally hemispherical shape with a plurality of equally spaced apart and outwardly extending footings 24 for providing additional stability to the base 12. The base 12 is preferably formed with smooth or curved edges and corners. The base 12 further includes an opening (not shown) for the insertion of additional material such as water, sand, etc. The base 12 is coupled to the arm 14 through the pivot 18. The base 12 provides support for the amusement apparatus 10 and prevents the amusement apparatus 10 from tipping over or falling to one side. The base 12 is made of a generally lightweight, durable material. Preferably, the base 12 is made of molded plastic, but alternatively, the base 12 can be made of other materials such as wood, metal, ceramics. In a preferred embodiment, the base 12 is made out of rotationally molded plastic. In an alternative embodiment, the base 12 can also include at least one stake 26 downwardly extending from the lower side 20 of the base 12. The stake 26 is configured to secure the base into the ground. In another alternative embodiment, the base 12 can include a plurality of fasteners 28 for securing the base 12 to the ground, to a floor, or to another surface.

The arm 14 is an elongate member having a proximal end 30 and a distal end 32. The proximal end 30 of the arm 14 is rotatably and pivotally coupled to the base 12 through the pivot 18. The distal end 32 of the arm 14 includes a seat 34 and a biasing device receptacle 36. The arm 14 is sized such that the seat 34 generally outwardly extends beyond the outer diameter of the base 12. The arm 14 extends outwardly and upwardly from the upper surface 22 of the base 12. The arm 14 is configured to support a user, such as a child, during the operation of the amusement apparatus 10. The arm 14 is preferably formed with curved or smooth edges and corners. The arm 14 is made of a strong and relatively lightweight material. In a preferred embodiment, the arm 14 is made of rotationally molded plastic. Alternatively, the arm 14 can be made of other materials such as other plastics, wood, metal, or combinations thereof.

The seat 34 is integrally formed into the distal end 32 of the arm 14. The arm 14 has a curved notch defined into the upper side of the distal end 32 of the arm 14 to define the seat 34. Alternatively, the seat 34 can be removably attached to the distal end 32 of the arm 14. The seat 34 includes a handle portion 40 having at least one mandrel 42 for grasping by the user. In a preferred embodiment, the handle portion 40 includes two oppositely extending mandrels 42. The handle portion 40 upwardly extends from the arm 14 near the distal end 32 and is positioned on the proximal side of the seat 34. The seat 34 is configured such that the user can straddle the arm 14 while facing the base 12 and can grasp the mandrels 42 of the handle portion 40 with at least one hand. The seat 34 is configured to comfortably and securely support the user during operation of the amusement apparatus 10. The seat 34, integrally formed to the arm 14, is also made of molded plastic. Alternatively, the seat 34 can be made of other materials and can also further include, a cushionable member (not shown) on the seat 34. The mandrels 42 can also include cushionable hand grips.

The seat biasing receptacle 36 is integrally formed to the underside of the arm 14 at the distal end 32 of the arm 14. The receptacle 36 has a generally downwardly facing bowl shape and is configured to removably and securely connect to the resilient ball 16. The receptacle 36 is further configured to distribute the forces acting on the seat 34 from the resilient ball 16. The bowl like shape of the receptacle 36 facilitates the user's ability to direct the arm 14 in a clockwise or counter-clockwise direction about the base 12 by receiving, and reacting to, the non-vertical forces acting in the receptacle 36. The receptacle 36 also maintains the ball 16 in a fixed upright position relative to the arm 14 and prevents the ball 16 from rotating or tipping over.

The seat biasing device is a spring-like component. In a preferred embodiment, the seat biasing device is the relatively large, resilient ball 16. The ball 16 is removably connected to the distal end 32 of the arm 14 at the receptacle 36. The ball 16 is configured to repeatedly and resiliently contact the surface. The ball 16 is further configured to enable the user to bounce up and down off of the surface and to provide a soft contact with the surface during bouncing thereby cushioning the impact of the amusement apparatus 10 with the surface. The ball 16, when connected to the arm 14 is preferably configured to position the child such that the child's feet can contact the ground to enable a child seated in the seat 34 to use his or her feet to move about the base in a clockwise or counterclockwise direction. Thus, the child may use his or her feet to aid in the operation of the amusement apparatus 10. In an alternative embodiment, the ball 16 can be configured such that a child's feet do not contact the ground. The ball 16 is made of an elastomeric material. In a preferred embodiment, the ball 16 is made of a rubber. Alternatively, the ball 16 can be made of other materials, such as plastic.

The pivot 18 is a coupling device. The pivot 18 is removably connected to the upper surface 22 of the base 12 and to the proximal end 30 of the arm 14. The pivot assembly 18 further includes an adjustable biasing member 46. The biasing member 46 removably connects the proximal end 30 of the arm 14 to the pivot 18. The pivot 18 is made of a strong and lightweight material. In a preferred embodiment the pivot is made out of molded plastic. Alternatively, the pivot can be made out of other materials such as other plastics, wood, metal, or ceramics. The pivot 18 is configured to enable the arm 14 to rotate about a substantially vertical axis 48 and to pivot about a substantially horizontal axis 50, thereby enabling the user to move up and down or left and right. The pivot 18 is preferably formed of smooth or curved edges and corners.

Figure 2:
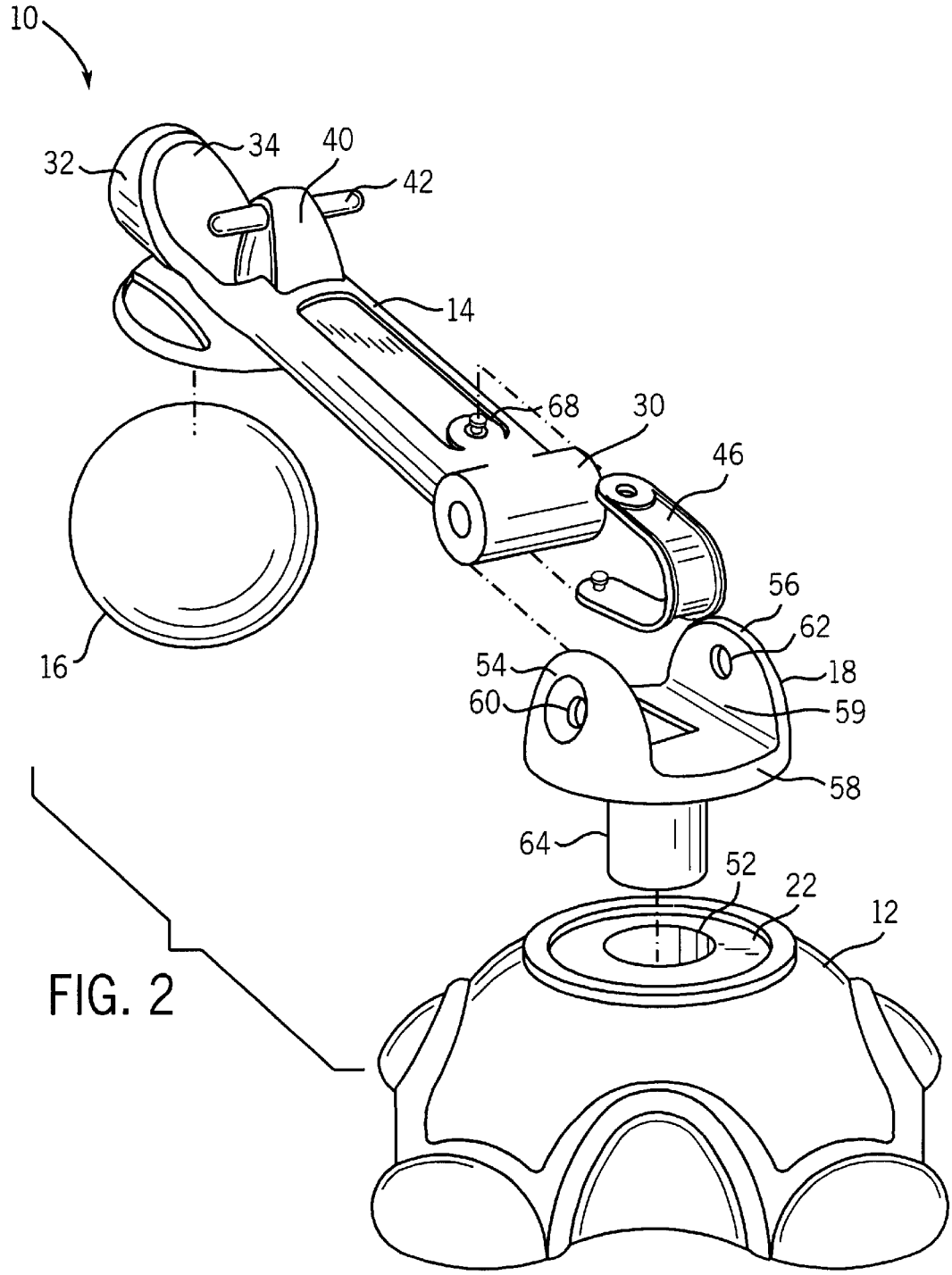
FIG. 2 is an exploded perspective view of the amusement apparatus of FIG. 1.

FIG. 2 illustrates the amusement apparatus 10 in greater detail. The base 12 further includes a bore 52 defined within the base 12 at the upper surface 22. The bore 52 is generally vertically defined within the base 12 and is configured to receive a portion of the pivot 18. The bore 52 of the base 12 is configured to enable the rotational movement of the arm 14 and the pivot 18 about the base 12.

The pivot 18 includes an upper portion and a lower portion. The upper portion of the pivot 18 includes two upwardly extending and substantially parallel arms 54 and 56 spaced apart by a disk 58. The arms 54, 56 and the disk 58 of the pivot 18 define a channel 59 for receiving the proximal end 30 of the arm 14 and the biasing member 46. Each of the arms 54, 56 includes an opening 60, 62, respectively, for receiving a connection means for connecting the proximal end 30 of the arm 14 to the pivot 18. The proximal end 30 of the arm 14 can be connected to the pivot 18 at the openings 60, 62 through fasteners or the snap fit projections extending from the proximal end 30 of the arm 14. The lower portion of the pivot 18 includes a journal 64 which downwardly extends from a lower surface of the disk 58 of the upper portion of the pivot 18. The journal 64 is configured to removably fit within the bore 52 of the base 12 and to enable the pivot 18 to rotate three hundred sixty degrees or more within the base 12 in either a clockwise or counterclockwise direction.

The biasing member 46 is preferably an elastic band. The biasing member 46 is removably connected to an upper surface of the disk 58 of the pivot 18, wraps around the proximal end 30 of the arm 14, and removably connects to a projection 68 upwardly extending from the upper surface of the arm 14 at the proximal end 30 of the arm 14. The proximal end 30 of the arm 14 preferably is formed in a generally cylindrical shape extending transverse to a longitudinal axis of the arm 14. The cylindrical outer surface of the proximal end 30 provides a bearing surface for the biasing member 46 between the pivot 18 and the projection 68. In an alternative embodiment, the biasing member 46 can be comprised of one or more bands, wherein each individual band is sized to support a specific weight. The biasing member 46 is configured to upwardly bias the distal end 34 of the arm 14 in order to project the arm 14 in an upward angle relative to the surface. The biasing member 46 is further configured to support or lift the user, particularly a child, above the surface when the child is seated in the seat 34 of the arm 14. The biasing member 46 facilitates or assists the child in bouncing up and down and provides a lifting sensation to the child, enabling even, a small child to develop an up and downward movement while on the seat 34. In a preferred embodiment, the biasing member 46 is a plurality of bands formed in a variety of strengths to enable a user to custom fit a band to the specific needs of the child. The biasing member 46 is configured to be easily, removably and replaceably connected to the pivot 18 and to the arm 14. In an alternative embodiment, the biasing member 46 can be replaced with a different biasing device such as a spring. In an alternative embodiment, the base 12 can be configured with an upwardly extending journal, and the pivot 18 can include an opening for receiving the upper extended journal of the base 12. The biasing member 46 is made of an elastomeric material. In a preferred embodiment, the biasing member 46 is made out of a rubber.

Figure 3:
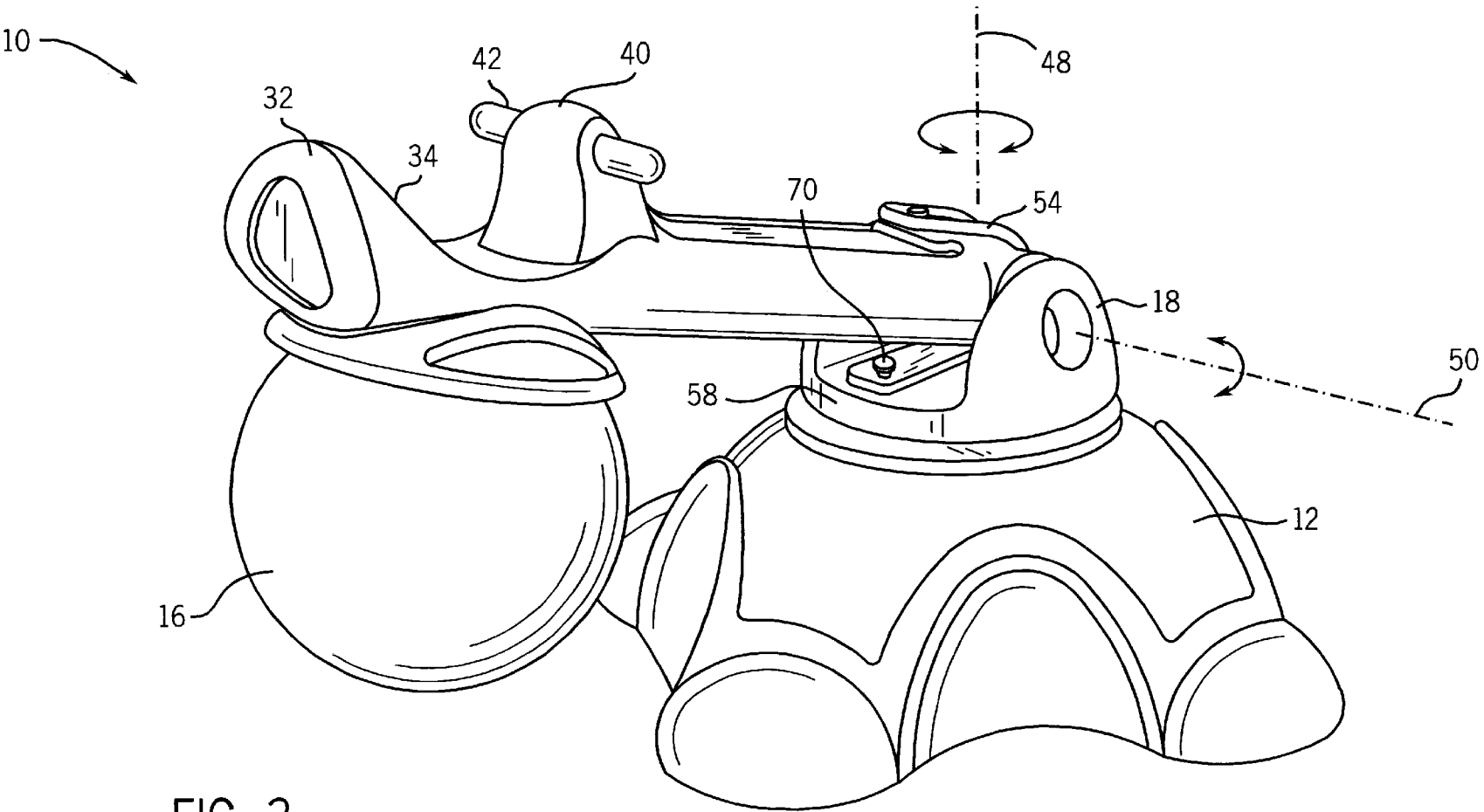
FIG. 3 is an alternate perspective view of the amusement apparatus of FIG. 1.

Referring to FIG. 3, the amusement apparatus 10 is shown in greater detail. The pivot 18 includes a pivot projection 70 upwardly extending from the upper surface of the disk 58 of the pivot 18. The pivot projection 70 is configured to removably connect to the second end of the band 54.

In operation, the child can straddle the seat 34 and bounce up and down such that the arm 14 pivots about the axis 50. Then, by shifting his or her weight to the left or the right during bouncing, or by using his or her feet, the child can cause the seat 34 to rotate about the axis 48 in a clockwise or a counterclockwise direction.

Figure 4:
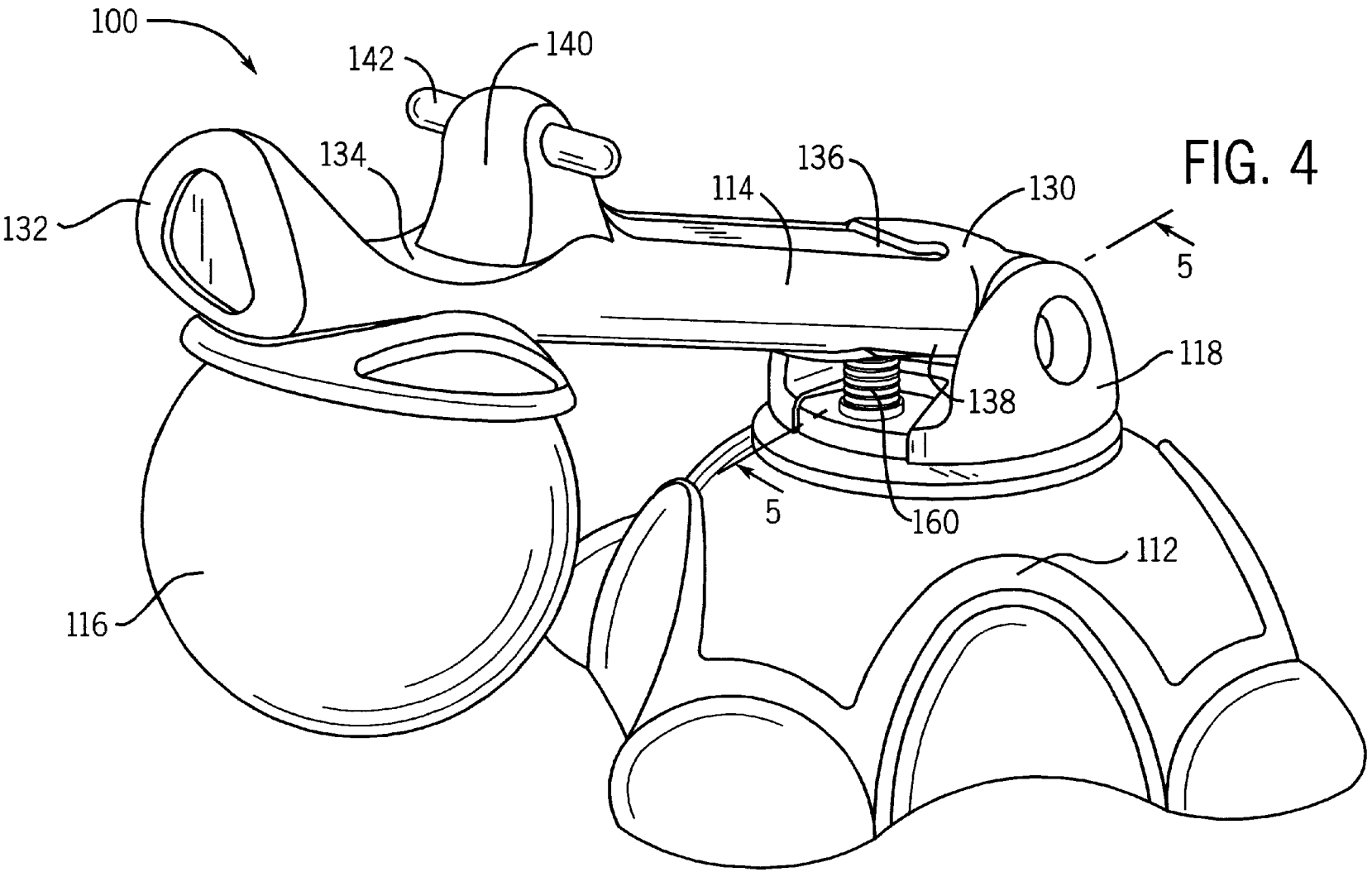
FIG. 4 is a perspective view of an alternative embodiment of the amusement device of the present invention.

An alternative embodiment of the rotatable and pivotable amusement apparatus is indicated in general at 100 in FIG. 4. The alternative embodiment includes a base 112, an arm 114 and a pivot member 118. The arm 114 includes a distal end 132 and a proximal end 130. The distal end 132 includes a seat 134 and a seat biasing device 116 positioned below the seat. The proximal end 130 of the arm 114 is connected to the pivot member 118. An arm biasing device 160 is positioned so that it connects the proximal end 130 of the arm 114 and the pivot member 118. The seat biasing device 116 is connected to the distal end 132 of the arm 114 and the pivot member 118 is connected to the base 112 in the same fashion as described above.

Figure 5:
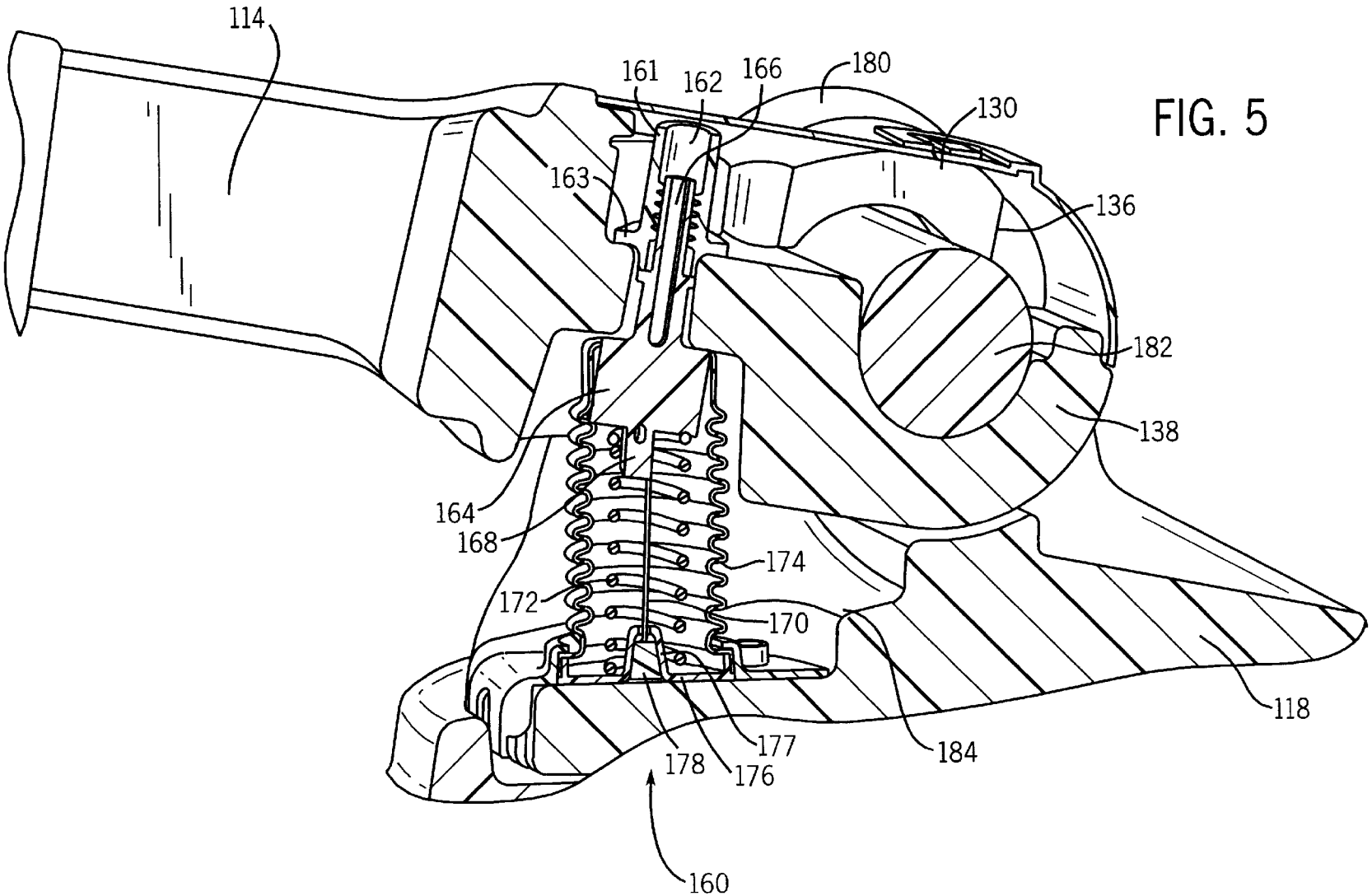
FIG. 5 is a partial sectional view of the arm biasing device in the alternative embodiment illustrated in FIG. 4.

FIG. 5 illustrates a sectional view of the proximal end 130 of the arm 114 connected to the pivot member 118. The pivot member 118 includes two arms 180 (only one of the arms is illustrated in FIG. 5) with a rod 182 positioned therebetween and a base 184. The proximal end 130 of the arm 114 includes a top portion 136 and a bottom portion 138. The proximal end 130 of the arm 114 is connected to the pivot member 118 by positioning the bottom portion 138 of the proximal end 130 between the arms 180 and underneath the rod 182 of the pivot member 118. The top portion 136 of the proximal end 130 is then positioned between the arms 180 and on top of the rod 182. The top portion 136 is connected to the bottom portion 138 to form the proximal end 130 of the arm 114. The proximal end 130 pivots about the rod 182 of the pivot member 118 thereby pivoting the arm 114 up and down.

FIG. 5 also illustrates the arm biasing device 160 of the present invention. The arm biasing device 160 is connected to the proximal end 130 of the arm 114 and the base 184 of the pivot member 118. The arm biasing device 160 upwardly biases the seat 134 at the distal end 132 of the arm 114.

The arm biasing device 160 includes a housing 161, a connection member 164, a spring 172 and a plate 176. The plate 176 includes a projection 177 and a stop 178 positioned therein. The projection 177 is cone shaped and includes a hole in the center. The stop 178 is also cone shaped and is designed to occupy the space within the projection 177.

The housing 161 is positioned within a cavity in the arm 114. The housing 161 is cylindrical with a hollow center 162. The housing 161 includes a circumferential flange 163 positioned near the bottom of the outside surface of the housing 161. The hollow center 162 of the housing 161 includes threads positioned on at least a portion of the hollow center 162.

The connection member 164 includes two rods 166 and 168, one positioned at either end of the connection member 164. The upper end 166 of the connection member 164 contacts the threads in the hollow center 162 of the housing 161 thereby securing the connection member to the housing 161 and the arm 114. A steel cable 170 connects the connection member 164 and the plate 176. More specifically, the steel cable 170 is connected to the lower end 168 of the connection member 164 through the hole in the projection 177 of the plate 176 to the stop 178 that is positioned within the projection 177. The steel cable 170 secures the elements of the arm biasing device 160 together.

The arm biasing device 160 also includes a sleeve 174. The sleeve 174 extends from the lower portion of the arm 114 to the base 184 of the pivot member 118. The sleeve 174 covers and protects the spring 172. The sleeve 174 is made from a flexible material such that when the arm biasing device 160 is compressed the sleeve 174 compresses with the spring 172.

When a child sits on the seat 134 at the distal end 132 of the arm 114, the proximal end 130 of the arm 114 pivots downward. As the proximal end 130 pivots downward, the arm biasing device 160 compresses since the connection member 164 compresses the spring 172. As the compressed spring 172 expands, the arm biasing device 160 upwardly biases the seat 134 of the distal end 132.

The arm biasing device 160 is configured to lift and support the user above the surface when the child is seated in the seat 134 of the arm 114. The spring arm biasing member 160 facilitates or assists the child in bouncing up and down and provides a lifting sensation to the child, enabling even a small child to develop an up and downward movement while on the seat.

While preferred embodiments of the present invention have been described and illustrated, numerous departures therefrom can be contemplated by persons skilled in the art, for example, the base 12 can be a pole connected to the ground and the arm can be pivotally and rotatably connected to the pole. Additionally, the seat 34 can be positioned in alternate positions on the arms. For example, the seat 34 could be positioned transverse to the longitudinal axis of the arm 14 such that, in operation, the child does not face the base 12. Therefore, the present invention is not limited to the foregoing description but only by the scope and spirit of the appended claims.

What is claimed is:

1. An amusement apparatus comprising:

a base configured for placement onto a generally horizontal surface;

an arm having a distal end and a proximal end, the proximal end of the arm rotatably and pivotally coupled to the base, the distal end of the arm including a seat;

a seat biasing device coupled to the seat and configured to repeatedly and resiliently contact the surface; and an arm biasing device connected to the base and the proximal end of the arm, the arm biasing device configured to upwardly bias the seat of the arm.

2. The apparatus of claim 1, further comprising a pivot member connected to the base and to the proximal end of the arm.

3. The apparatus of claim 2, wherein the pivot member includes two arms with a rod positioned therebetween, whereby the proximal end rotates and pivots about the rod.

4. The apparatus of claim 2, wherein the arm biasing device is connected to a base of the pivot member.

5. The apparatus of claim 2, wherein the arm biasing device includes a spring extending from the arm to the pivot member.

6. The apparatus of claim 1, wherein the seat biasing device is a resilient ball.

7. The apparatus of claim 6, wherein the resilient ball is made of a elastomeric material and is configured to enable a child to softly bounce off of the surface.

8. The apparatus of claim 1, wherein the arm biasing device is configured to bias the seat biasing device above the surface and to permit substantially vertical oscillation and rotational oscillation.

9. The apparatus of claim 1, wherein at least one handle is coupled to the distal end of the arm adjacent to the seat.

10. The apparatus of claim 1, wherein the arm biasing device includes a housing positioned in a cavity inside the proximal end of the arm;

a member connected to the housing;

a plate positioned below the member and connected to the member by a cable; and a spring positioned between the member and the plate, whereby the member compresses the spring when a force is exerted on the distal end of the arm.

11. The apparatus of claim 10, wherein the housing includes a hollow center with threads positioned on a portion of the center.

12. The apparatus of claim 10, wherein the arm biasing device further includes a sleeve that covers the spring.

13. The apparatus of claim 10, wherein the plate includes a projection with a stop positioned therein, wherein the cable is connected to the stop and extends through a hole in the center of the projection.

* * * * *